US007458898B1

(12) United States Patent
Goding

(10) Patent No.: US 7,458,898 B1
(45) Date of Patent: Dec. 2, 2008

(54) PLAY AREA COVER

(76) Inventor: Mike Goding, 4309 N. 142nd St., Omaha, NE (US) 68164

( * ) Notice: Subject to any disclaimer, the term of this patent is extended or adjusted under 35 U.S.C. 154(b) by 293 days.

(21) Appl. No.: 11/414,580

(22) Filed: Apr. 28, 2006

(51) Int. Cl.
*A63G 31/00* (2006.01)

(52) U.S. Cl. ..... 472/126; 4/496

(58) Field of Classification Search ..... 472/126; 4/496, 498, 503; 135/90
See application file for complete search history.

(56) References Cited

U.S. PATENT DOCUMENTS 349,066 A * 9/1886 Stahol ..... 43/126
645,890 A * 3/1900 Conrad ..... 47/23.2
3,683,427 A * 8/1972 Burkholz et al. ..... 4/499
3,832,741 A * 9/1974 Ward ..... 4/500
5,621,926 A * 4/1997 La Madeleine ..... 4/498
5,769,105 A * 6/1998 Margol et al. ..... 135/90
6,487,734 B1 * 12/2002 First ..... 4/498

* cited by examiner

*Primary Examiner*—Kien Nguyen
(74) *Attorney, Agent, or Firm*—Dennis L. Thomte; Thomte Patent Law Office

(57) ABSTRACT

A play area cover is provided with a flexible sheet member that is urged into a generally convex shape over the play area to shed water and debris away from the cover and the play area. Various structural embodiments are provided for defining the convex shape of the cover. Anchoring mechanisms are provided for releasably securing the cover with a base frame of the play area. Safety mechanisms are incorporated within the supporting and anchoring systems to substantially prevent injury to children and animals around the play area.

3 Claims, 7 Drawing Sheets

PLAY AREA COVER

BACKGROUND

Outdoor play-sets have become increasingly popular in residential areas. The play-sets come in a variety of shapes and sizes. However, many play-sets typically incorporate one or more ground level play areas, such as a sandbox. These areas may be filled with sand, rubber or composite material in which children may dig and play. However, due to the fact that the play-sets reside outdoors, the play areas tend to fill with rainwater, leaves and other debris. While the accumulation of such foreign material within the play area is undesirable, none may be more undesirable than the unwanted addition of pet waste.

While it is desirable to provide a simple means for covering such play areas when they are not in use, the prior art has failed to provide an adequate cover. For example, various outdoor sandboxes have been provided with a rigid cover that secures with a lower portion of the sandbox. While these can be effective for keeping water and other debris from within the play area when it is not in use, such covers are bulky and cumbersome to deal with when installing and removing the same. Moreover, such covers frequently become the subject of play with many children and may lead to unwanted injury to children or surrounding articles within the area. Other prior art methods of covering the play areas may simply utilize a tarp. However, the tarp typically sags into a concave shape over the play area and tends to accumulate water and debris. Accordingly, when the play area is to be used, the cover is difficult, if not impossible, to remove from the play area without spilling the water or debris into the play area. Moreover, the use of a tarp typically involves the use of inadequate anchoring systems, such as large rocks, or the like that weigh-down the peripheral edges of the tarp outside the play area. However, such means typically become the subject of play with some children and are either lost or risk injury to the children or surrounding articles.

Accordingly, what is needed is a play area cover that substantially prevents water and other debris from accumulating within a play area, without accumulating the same water and debris on top of the cover, and also prevents animals from entering the play area. Moreover, such a play area cover should be provided in a manner that is lightweight, safe and easy to use.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A play area cover is generally provided with a flexible sheet member, having an upper surface, a lower surface and a peripheral edge portion. An anchoring means is provided for securing the peripheral edge portion of the sheet member with a base frame of the play area. A support means is also provided for urging the upper surface of the sheet member into a generally convex shape above the play area, so that water and debris is effectively shed from the cover.

In one aspect of the invention, an elongated cable supports a central portion of the flexible sheet member by securing a distal end portion of the cable to a play structure above the play area. A detachment means may be provided for automatically uncoupling a portion of the cable with the play structure when an external force is applied to the sheet member or the cable in order to prevent harm to individuals or the cover system. In another embodiment, one or more elongated, deformably resilient braces are coupled within sleeves along the sheet member, in a manner that supports the sheet member into a generally convex shape above the play area. In still another embodiment, a support block may be placed beneath the sheet member on top of the play area. An upper end portion of the support block engages the lower surface of the sheet member in a manner that urges the sheet member into a generally convex shape above the play area.

The anchoring means may be provided by a plurality of elongated anchor cables that extend outwardly from the peripheral edge portion of the sheet member. Securement pins may be coupled with the distal end portions of the elongated cables for releasably engaging the same with the base frame of the play area.

It is therefore a principal object of the present invention to provide a play area cover that substantially prevents animals, water and other debris from entering a play area when it is not in use.

A further object of the present invention is to provide a play area cover that is comprised of a flexible sheet member that is urged into a generally convex shape above a play area.

Still another object of the present invention is to provide a play area cover that is urged into a convex shape above the play area through the use of an elongated cable that is secured with a play structure above the play area.

Yet another object of the present invention is to provide a play area cover that is comprised of a flexible sheet member, which is urged into a generally convex shape above a play area with the assistance of deformably resilient braces that are coupled within sleeves coupled to the sheet member.

A further object of the present invention is to provide a play area cover that is comprised of a flexible sheet member, which is urged into a generally convex shape above a play area through the use of a deformably resilient support block placed beneath the sheet member.

Still another object of the present invention is to provide a play area cover that is releasably anchored to a base frame of the play area using a plurality of elongated anchor cables.

Yet another object of the present invention is to provide a play area cover that incorporates the use of several safety mechanisms in supporting and securing the play cover with respect to the play area.

A further object of the present invention is to provide a play area cover that is relatively simple to manufacture and use.

Still another object of the present invention is to provide a play area cover that may be conveniently folded and stored in a compact form.

These and other objects of the present invention will be apparent after consideration of the Detailed Description and Figures herein.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
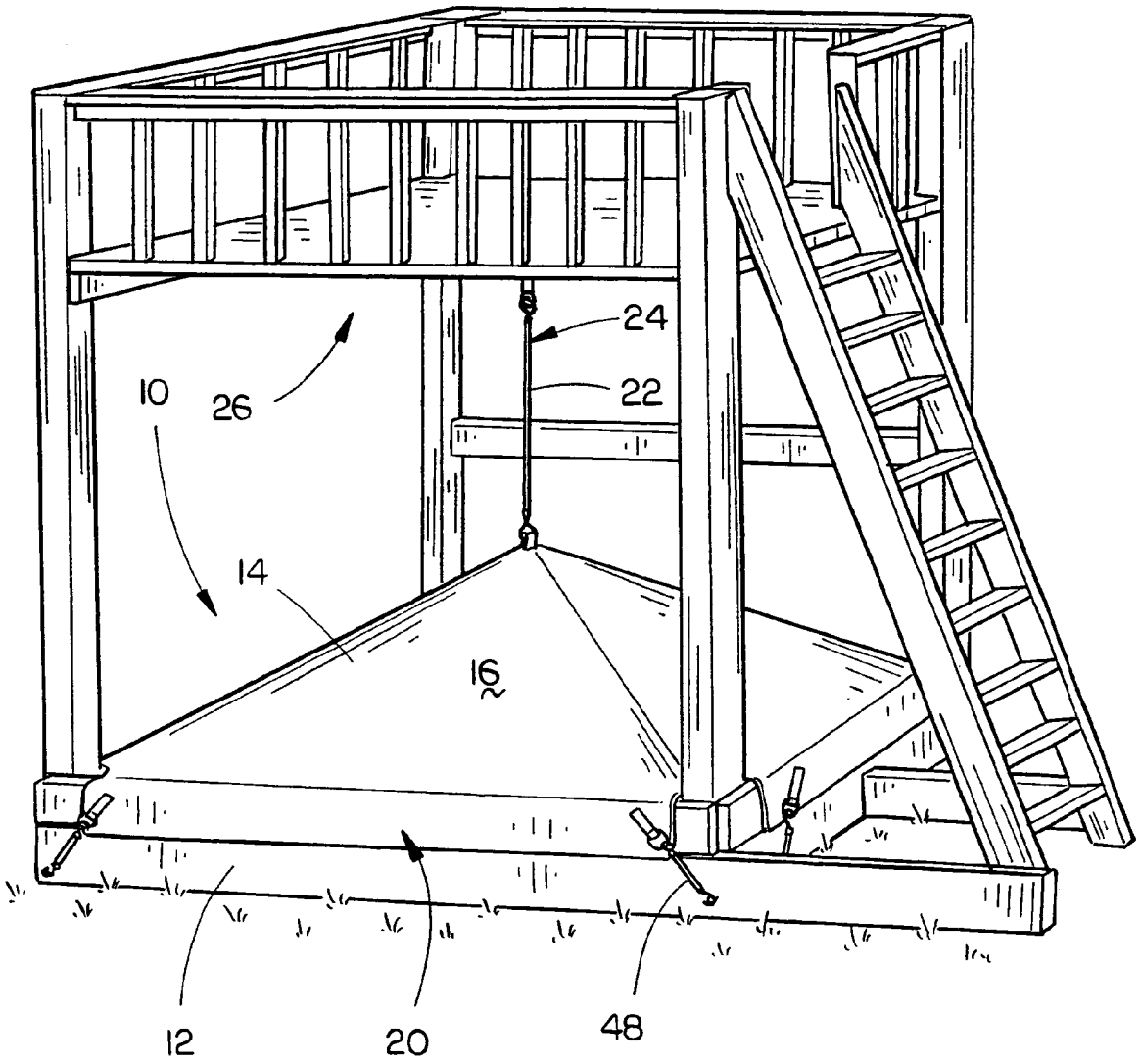
FIG. 1 depicts a perspective view of one preferred embodiment of the play area cover as it could be used to cover an area beneath a play structure.
Figure 2:
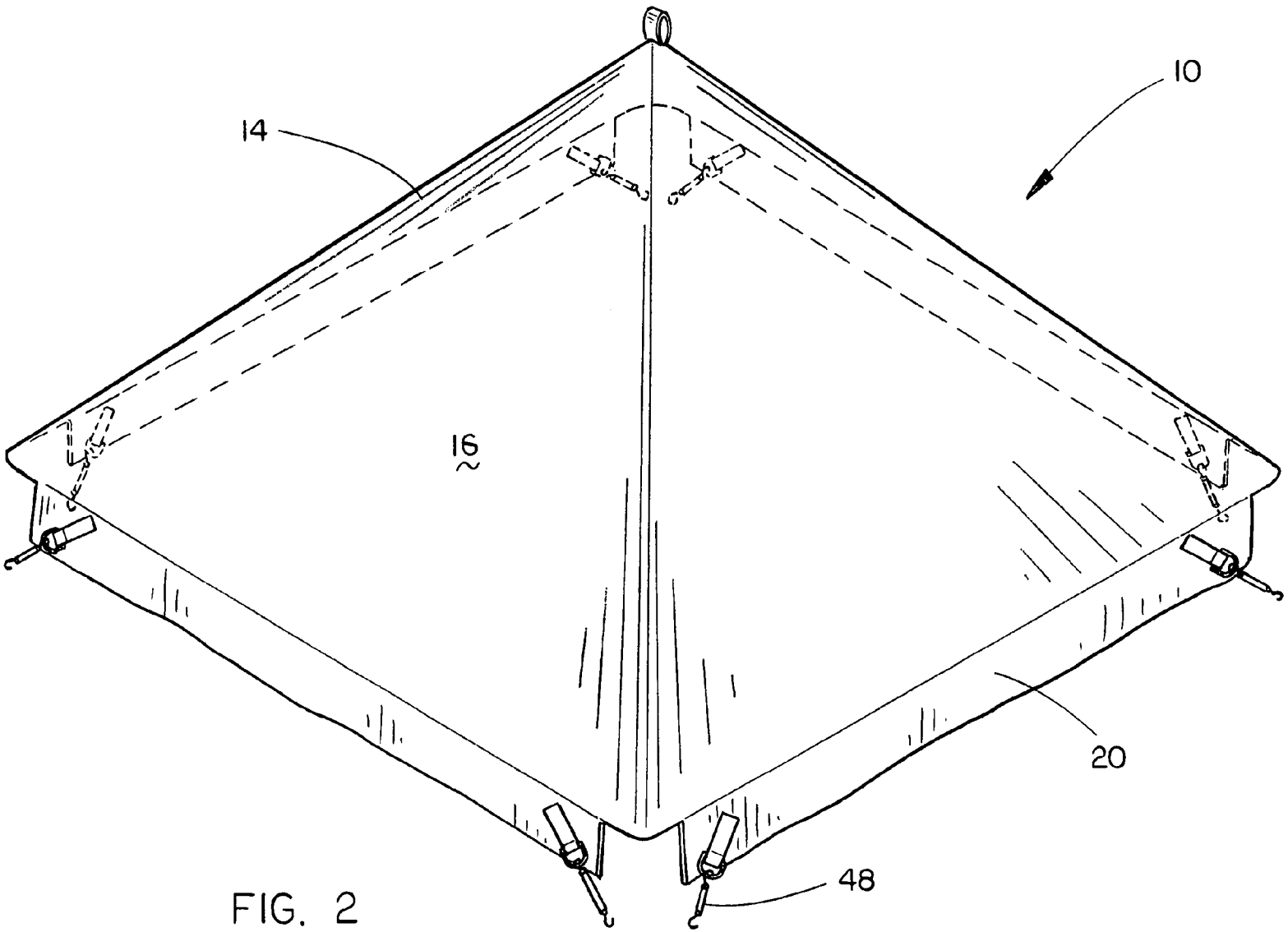
FIG. 2 depicts a perspective view of another preferred embodiment of the play area cover.
Figure 3:
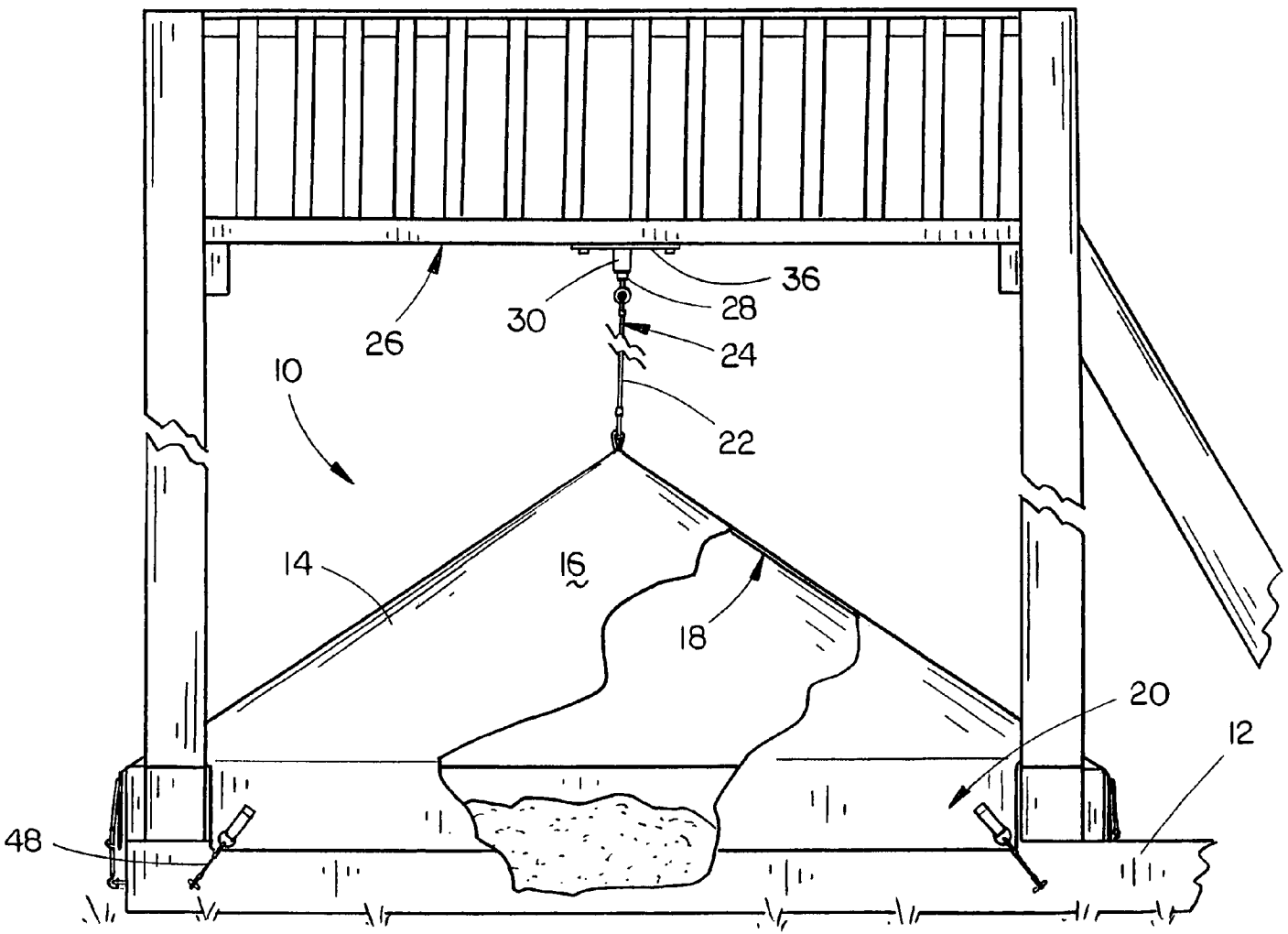
FIG. 3 depicts a side elevation view of the play area cover of FIG. 1 as it could be used to cover an area beneath a play structure.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The play area cover 10 is generally provided for use with a play area having a base frame 12 that surrounds a portion of the play area. The play area cover 10 is preferably formed from a generally flexible sheet member 14, having an upper surface 16, a lower surface 18, and a peripheral edge portion 20. It is contemplated that the sheet member 14 could be comprised of nearly any flexible material, including various fabrics, polymers, and combinations thereof. It will simply be desirable to form the sheet member 14 from a material that is substantially water resistant to prevent the infiltration of water into the play area when the play area cover 10 is installed. It may be desirable to form the sheet member 14 from a material that is sufficiently flexible to permit the sheet member 14 to be folded into a compact size for easy storage when the play area cover 10 is not in use.

Figure 5:
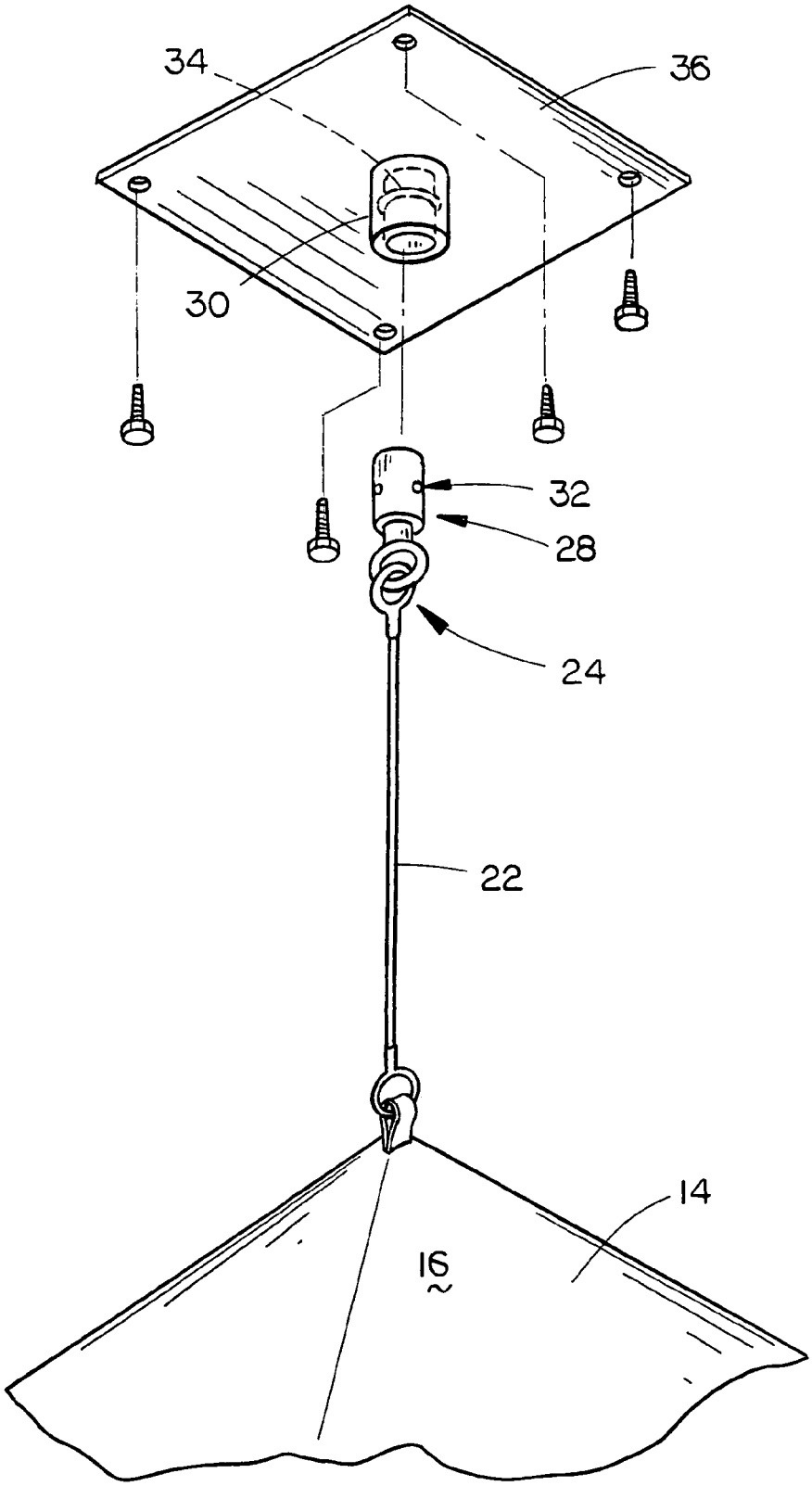
FIG. 5 depicts an isometric view of at least a portion of one embodiment of a support system for the play area cover depicted in FIG. 1.

The play area cover 10 is preferably provided with a support means for urging the upper surface 16 of the sheet member into a generally convex shape above the play area, as depicted in FIGS. 1, 3, 6 and 8. In one embodiment, the support means is comprised of an elongated, flexible cable 22 that is operatively coupled with, and extends outwardly from, a generally central portion of the upper surface 16 of the sheet member 14. It is contemplated that the flexible cable 22 may be comprised of a material that is deformably resilient in nature. This will provide a level of resiliency to the play area cover 10 in the event that an individual or animal inadvertently comes into contact with the same or ice and snow accumulate on top of the play area cover 10. In any event, a distal end portion 24 of the cable 22 should be coupled in some manner with a play structure 26 that is positioned above the play area. In order to provide an additional measure of safety, a detachment means may be provided for automatically uncoupling at least a portion of the flexible cable 22 from the play structure 26 when a sufficient external force is applied to the sheet member 14 or the flexible cable 22. Such a detachment means may be provided in the form of a first latching component 28 that is coupled with one portion of the flexible cable 22. A second latching component 30 may be provided with a shape and size that permits the first latching component 28 and second latching component 30 to be selectively engagable with one another in a press-fit fashion. For example, FIG. 5 depicts the second latching component 30 as a socket that releasably receives a post-shaped first latching component 28. Raised surface features 32 may be provided to be received within a recess 34 to provide the press-fit engagement. The surface features 32 may, themselves, be resiliently deformable or biased in some manner. Other engagements such as friction fit and other structural arrangements are contemplated. The second latching component 30 may be provided with a mounting plate 36, or other such structural detail, for securing the second latching component 30 with the play structure 26. It is also contemplated, however that the first latching component 28 and second latching component 30 could be coupled with one another between two lengths of cable 22, each length of cable being secured either to the sheet member 14 or the play structure 26, respectively. This arrangement will effectively provide a cable 22 that is easily split into two pieces when an external force is applied to the cable 22 or the sheet member 14.

Figure 6:
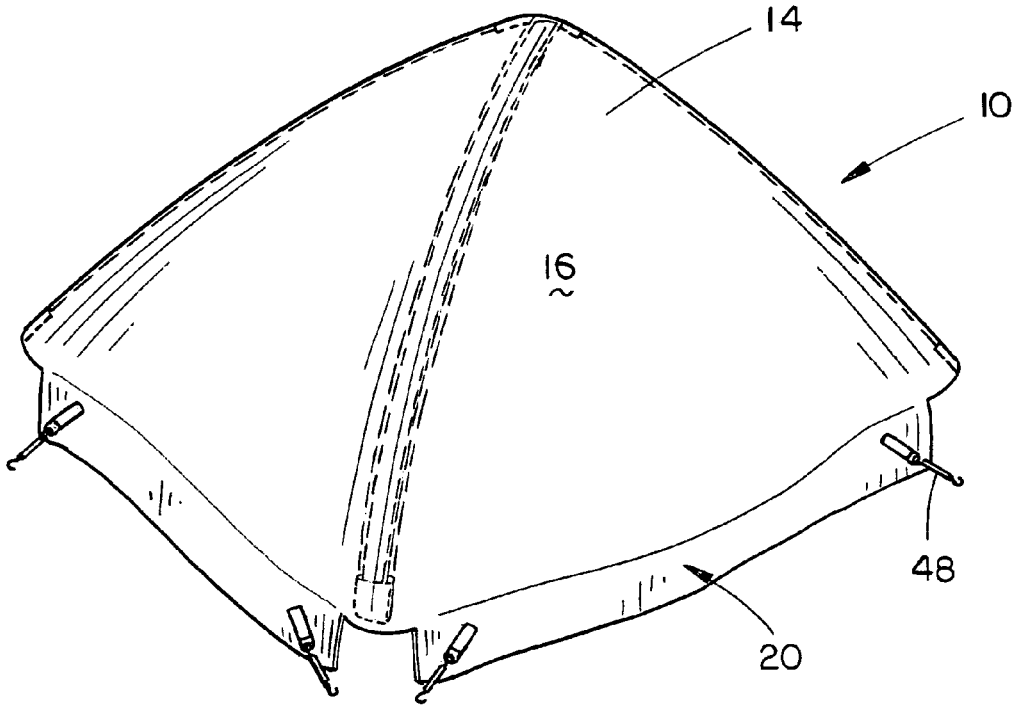
FIG. 6 depicts a perspective view of another embodiment of the play area cover.
Figure 7:
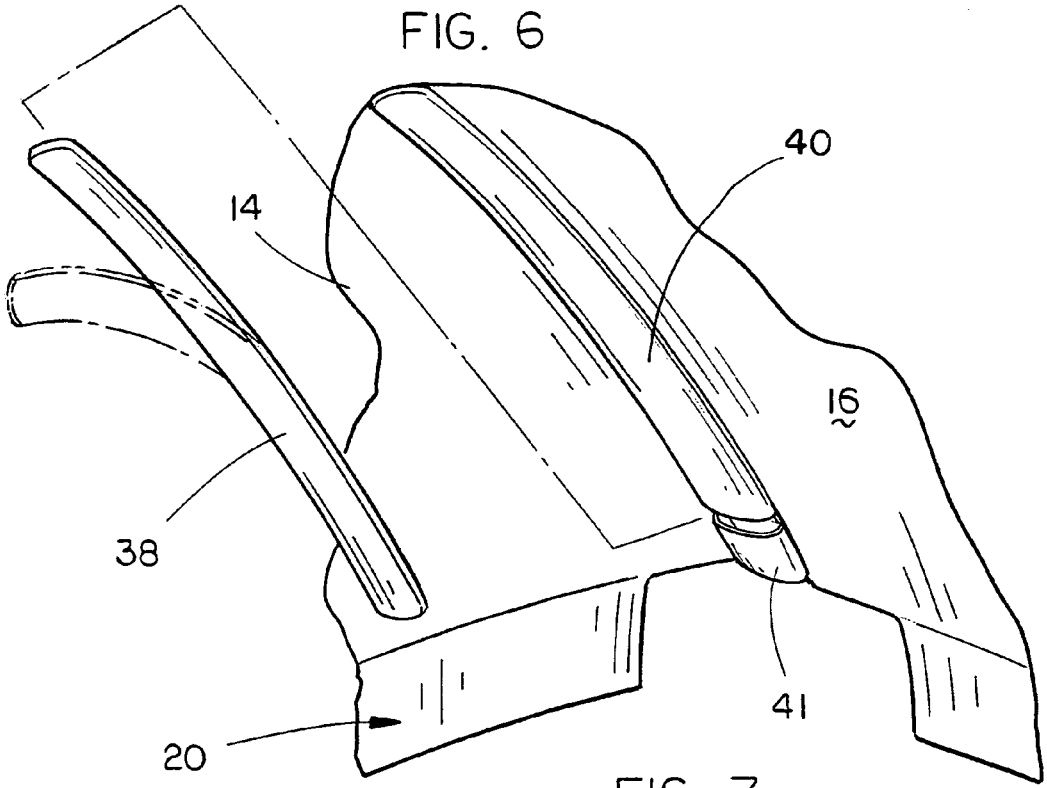
FIG. 7 depicts an isometric view of at least a portion of one embodiment of a support system for the play area cover depicted in FIG. 6.

In another embodiment, depicted in FIGS. 6 and 7, the support means may be provided in the form of one or more elongated, generally deformably resilient braces 38 that are coupled with the sheet member 14 in a manner that supports the sheet member 14 into a generally convex shape above the play area. The support means may be further comprised of a plurality of sleeves 40 that are coupled to the sheet member 14 in positions that permit each of the sleeves 40 to receive a brace 38, such that the brace 38 supports the sheet member 14 in the desired, generally convex shape above the play area. It is contemplated that the braces 38 may be provided to extend from the peripheral edge portion 20 of the sheet member 14 to a center portion, or extend completely across the sheet member 14, from one portion of the peripheral edge 20 to another. The braces 38 may be removably disposed within the sleeves 40 by providing an opening 41 at one end of each of the sleeves 40. The openings may be formed in various pocket-like configurations to releasably secure the braces 38 within the sleeves 40 so that the braces 38 do not become unintentionally removed from within the sleeves 40, such as when a child comes into contact with the play area cover 10. Moreover, while the braces 38 are depicted as being flat elongated members, it is contemplated that they may be formed to have nearly any cross-sectional shape that provides the desired flexing characteristics required by the circumstances presented.

Figure 8:
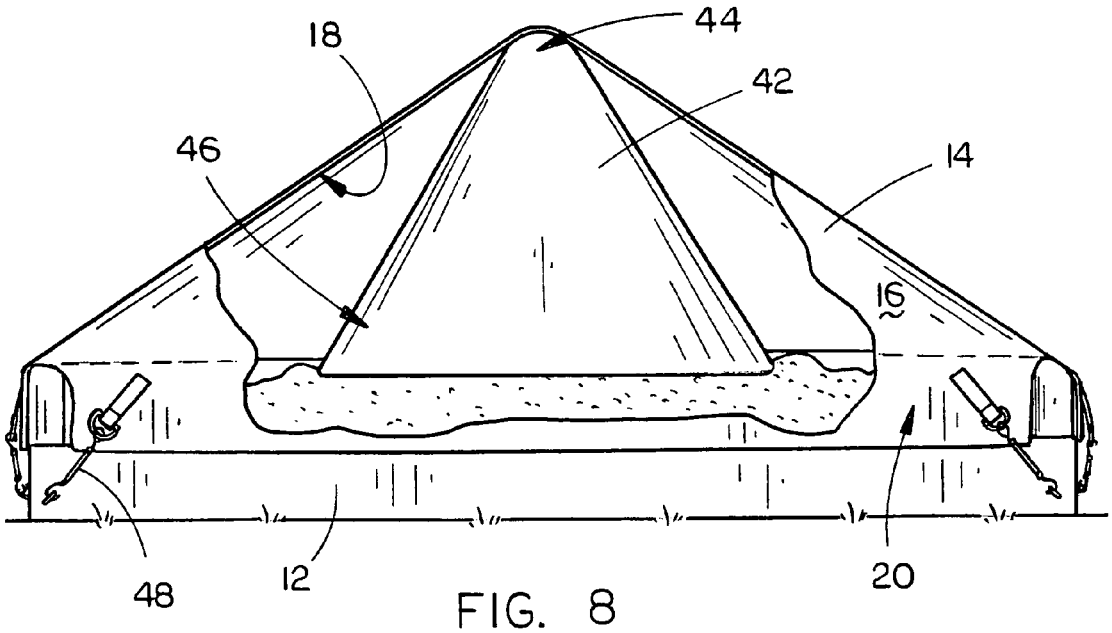
FIG. 8 depicts a side elevation view of the still another embodiment of the play area cover as it could be used to cover a play area, such as a sandbox.
Figure 9:
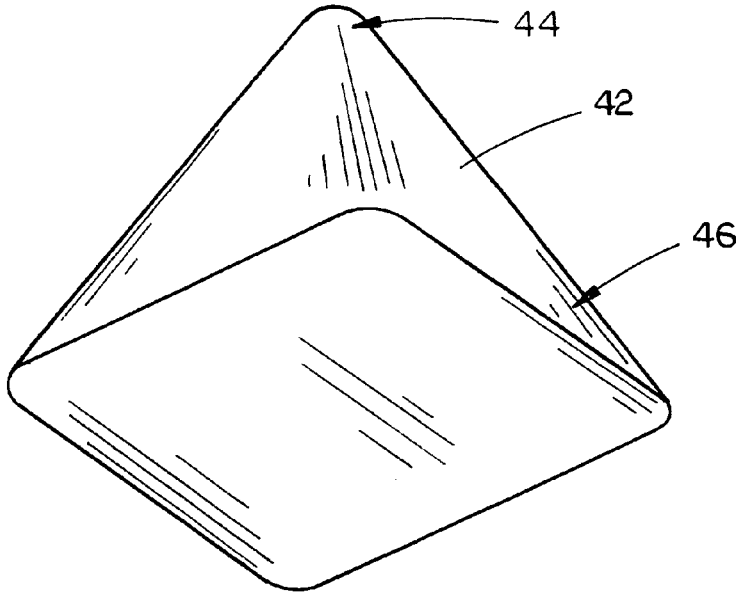
FIG. 9 depicts an isometric view of at least a portion of a support system for the play area cover depicted in FIG. 8.

In another embodiment, depicted in FIGS. 8 and 9, the support means may be provided in the form of a support block 42, having an upper end portion 44 and a lower end portion 46. The lower end portion 46 of the support block 42 should be shaped to conveniently engage the play area beneath the play area cover 10. Likewise, the upper end portion 44 of the support block 42 should be shaped in a manner that engages the lower surface 18 of the sheet member 14 in a manner that urges the sheet member 14 into the desired, generally convex shape, without placing an undesirable strain on the sheet member 14. While it is contemplated that the support block 42 may be provided in nearly any shape, a desirable shape provides the lower end portion 46 with a larger cross-sectional area than that provided to the upper end portion 44 in order to promote stability. It may also be desirable to form the support block 42 from a deformably resilient material so that individuals and animals will not be injured in the event that they should fall into the play area while the play area cover 10 is in position.

Figure 4:
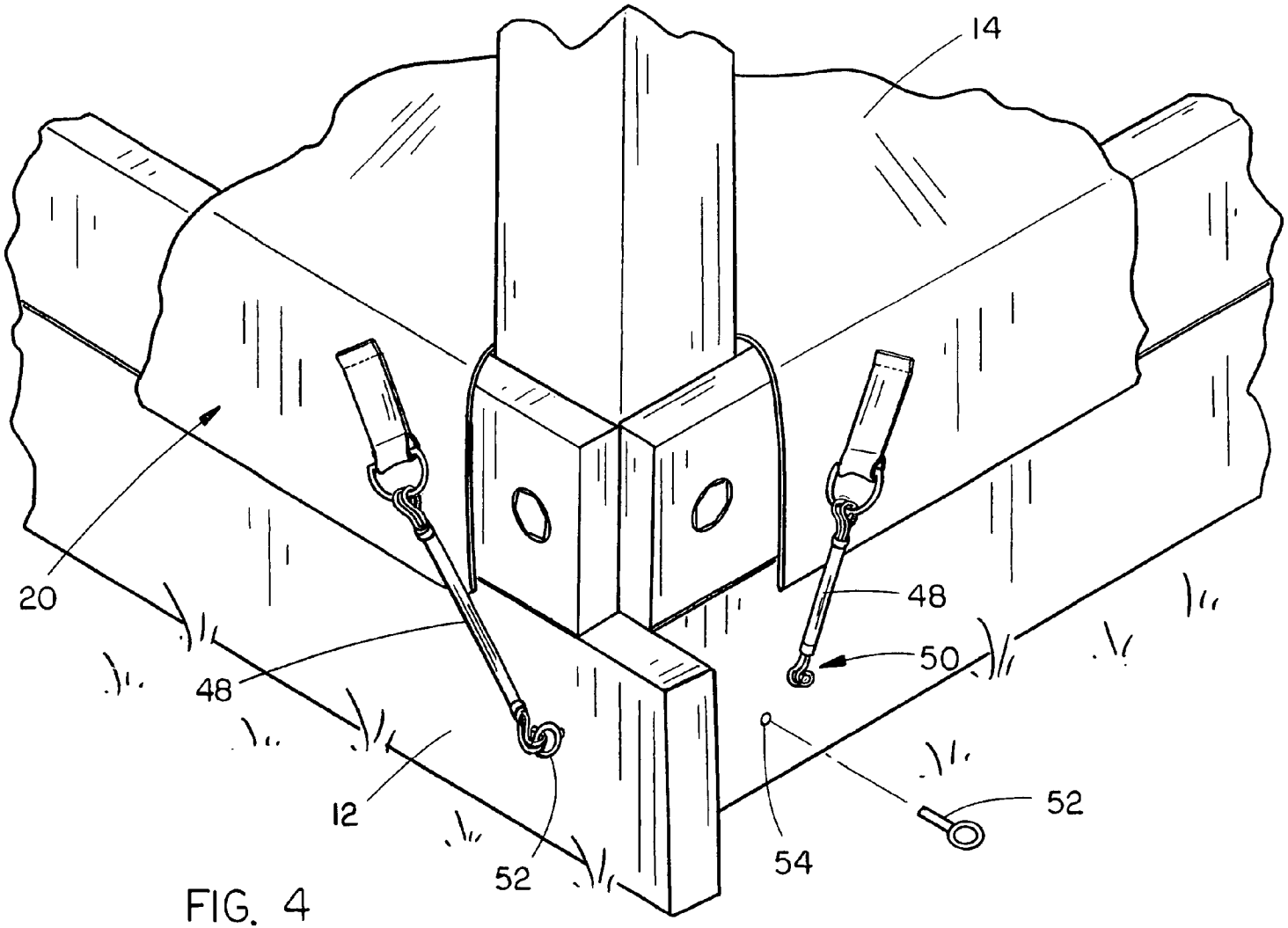
FIG. 4 depicts an isometric view of at least a portion of one embodiment of a securement system for the play area cover.

The anchoring means of the play area cover 10 may be provided in the form of a plurality of elongated anchor cables 48 that are coupled with the peripheral edge portion 20 of the sheet member 14 in a spaced-apart relationship with one another, as depicted in FIG. 4. Distal end portions 50 of the anchor cables 48 should be releasably coupled with the base frame 12. It is contemplated that the distal end portions 50 could be coupled with hooks, or other such structures to engage a shackle, eye-bolt, or other similarly shaped structures that are secured with the base frame 12. However, in a preferred embodiment, the distal end portions 50 of the anchor cables 48 are secured to the eyes of securement pins 52 that are releasably receivable within openings 54 formed in the base frame 12. In this manner the securement pins 52 are removed from the base frame 12 when the play area cover 10 is not in use, and thus, prevents loss of the securement pins 52 and unintentional contact between the anchoring means and individuals who may be moving past the base frame 12. It may be also preferable to form the anchor cables 48 from a resiliently deformable material to provide an easy means for stretching the anchor cables 48 into a taut engagement between the base frame 12 and the sheet member 14.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A cover for a play area having a base frame that at least partially surrounds a portion of the play area, the cover comprising:

a generally flexible sheet member, having an upper surface, a lower surface and a peripheral edge portion;

anchoring means for securing the peripheral edge portion of said sheet member with the base frame of the play area;

support means for urging the upper surface of the sheet member in a generally convex shape above the play area;

said support means being comprised of an elongated, flexible cable operatively coupled with, and extending outwardly from, a generally central portion of the upper surface of said sheet member;

a distal end portion of said flexible cable adapted to be operatively coupled with a play structure that is positioned above the play area;

a detachment means adapted to automatically uncouple at least a portion of said flexible cable with the play structure when external force is applied to said sheet member or said flexible cable;

said detachment means being comprised of a first latching component that is operatively coupled with one portion of said flexible cable and a second latching component; said first and second latching components being selectively engagable with one another in a press-fit fashion;

said second latching component being adopted to be operatively coupled with the play structure; and said second latching component being comprised of a mounting plate that is secured with the play structure and the first latching component is operatively coupled with the distal end portion of said flexible cable.

2. In combination:

a play area including a base frame extending therearound;

a flexible sheet member having an upper surface, a lower surface, and a peripheral edge portion;

an anchoring means which selectively secures said peripheral edge portion of said sheet member to said base frame;

a support means for urging said sheet member in a generally convex shape over said play area;

said anchoring means being comprised of a plurality of elongated anchor cables that are operatively coupled with the peripheral edge portion of said sheet member in a spaced-apart relationship with one another; distal end portions of said plurality of anchor cables being operatively, releasably coupled with the base frame.

3. The combination of claim 2 wherein each of the distal end portions of said plurality of anchor cables are operatively coupled with a securement pin that is releasably receivable within one or more openings in the base frame.

* * * * *